US008500664B2

(12) United States Patent
Numata et al.

(10) Patent No.: US 8,500,664 B2
(45) Date of Patent: Aug. 6, 2013

(54) MASSAGE CHAIR WITH FOOT MASSAGING DEVICE

(75) Inventors: Koichi Numata, Higashi-Osaka (JP); Shinsaku Shimizu, Higashi-Osaka (JP); Shigeki Noda, Higashi-Osaka (JP)

(73) Assignee: Daito Electric Machine Industry Company Limited, Osaka (JP)

( * ) Notice: Subject to any disclaimer, the term of this patent is extended or adjusted under 35 U.S.C. 154(b) by 347 days.

(21) Appl. No.: 12/992,563

(22) PCT Filed: Feb. 19, 2009

(86) PCT No.: PCT/JP2009/052855

§ 371 (c)(1),
(2), (4) Date: Nov. 12, 2010

(87) PCT Pub. No.: WO2010/035513

PCT Pub. Date: Apr. 1, 2010

(65) Prior Publication Data

US 2011/0066090 A1 Mar. 17, 2011

(30) Foreign Application Priority Data

Sep. 24, 2008 (JP) ..... P2008-244144

(51) Int. Cl.
*A61H 1/00* (2006.01)
*A47C 7/50* (2006.01)
*A47C 20/12* (2006.01)

(52) U.S. Cl.
USPC .... 601/104; 601/49; 297/423.19; 297/423.22

(58) Field of Classification Search
USPC ..... 601/46, 49, 86, 90, 98, 104, 115, 601/23, 24, 27, 29–35; 297/83, 84, 85 R, 297/85 M, 85 L, 85 C, 90–91, 423.1, 423.19, 297/423.26, 423.28, 423.3, 423.36, 423.38, 297/423.22
See application file for complete search history.

(56) References Cited

U.S. PATENT DOCUMENTS 2,484,803 A * 10/1949 Bell et al. ..... 297/423.22
2,901,025 A * 8/1959 Malitte ..... 297/423.24
4,386,803 A * 6/1983 Gilderbloom ..... 297/84
4,410,215 A 10/1983 McKean et al.

(Continued)

FOREIGN PATENT DOCUMENTS

JP 8-80230 A 3/1996
JP 11-19149 A 1/1999

(Continued)

*Primary Examiner* — Justine Yu
*Assistant Examiner* — Christopher Miller
(74) *Attorney, Agent, or Firm* — Birch, Stewart, Kolasch & Birch, LLP

(57) ABSTRACT

A massage chair with a foot massaging device, which includes a seat unit, a backrest unit, and the foot massaging device located at a front portion of the seat unit, can make the structure simpler, the weight lighter, and the cost lower all at once. The massage chair is provided under the seat unit 2 with a back-and-forth motion mechanism 15 joined to the foot massaging device 5, and when the back-and-forth motion mechanism 15 protrudes forward, the foot massaging device 5 advances to a using position U which is located in front of the seat unit 2 and at which a lower leg of a user can be massaged, while when the back-and-forth motion mechanism 15 retracts backward, the foot massaging device 5 is housed in a housing position P formed under the seat unit 2.

4 Claims, 10 Drawing Sheets

U.S. PATENT DOCUMENTS

| | | | | |
|---|---|---|---|---|
| 4,819,987 | A * | 4/1989 | Stringer | 297/423.35 |
| 5,560,681 | A * | 10/1996 | Dixon et al. | 297/284.11 |
| 5,890,766 | A | 4/1999 | Tsai | |
| 6,659,562 | B2 * | 12/2003 | Uchiyama | 297/423.3 |
| D586,138 | S * | 2/2009 | Potter | D6/367 |
| 2006/0241536 | A1 * | 10/2006 | Yoda et al. | 601/98 |
| 2007/0060850 | A1 * | 3/2007 | Lv | 601/84 |
| 2007/0232968 | A1 * | 10/2007 | Watanabe et al. | 601/90 |
| 2008/0183112 | A1 * | 7/2008 | Takebe | 601/29 |

FOREIGN PATENT DOCUMENTS

| | | | |
|---|---|---|---|
| JP | 2002-238963 | A | 8/2002 |
| JP | 2005-237486 | A | 9/2005 |
| JP | 2007-75590 | A | 3/2007 |

* cited by examiner

MASSAGE CHAIR WITH FOOT MASSAGING DEVICE

CROSS-REFERENCE TO RELATED APPLICATION

The present application is the National Phase of PCT Application No. PCT/JP2009/052855 filed Feb. 19, 2009, which claims priority under 35 U.S.C. 119 to Japanese Patent Application No. 2008-244144, filed Sep. 24, 2008.

TECHNICAL FIELD

The present invention relates to a massage chair with a foot massaging device.

BACKGROUND ART

A massage chair with a foot massaging device is disclosed in, for example, Japanese Unexamined Patent Publication JP-A 2002-238963.

This massage chair has a backrest unit at a rear portion of a seat unit and a foot massaging device at a front portion, and the backrest unit is equipped with a massage mechanism that massages the back of a user and the foot massaging device has built therein a lower-leg massage mechanism that massages the lower legs of the user. Additionally, the backrest unit is reclinable back and forth, and the foot massaging device is provided Swingably in a forward direction beyond the seat unit via a supporting member.

Such massage chairs are not only used for massaging purposes but oftentimes used simply as chairs. In particular, this kind of massage chair oftentimes has a soft cushion built in the seat unit and the like and a reclining function at the backrest unit, and hence is suitable for use as a sofa.

However, the foot massaging device in Japanese Unexamined Patent Publication JP-A 2002-238963 has holding depressions formed at the front, and the lower legs have to be fitted in the holding depressions even when the massage function is not to be used, which has restricted free movement of the feet and made comfortable postures difficult to take. This also has been a cause that undermines the appearance of the chair.

In view of this, and to address such inconveniences, the Applicants of the present application has already developed a technology such as in Japanese Unexamined Patent Publication JP-A 2007-75590.

The massage chair has a push-pull mechanism that is capable of moving the foot massaging device to a using position and to a built-in position located under the seat unit, and this push-pull mechanism has guiding tracks located at both sides of the massage chair, push-pull rods that move in and out along the guiding tracks, and carriage boards joined to the push-pull rods, the foot massaging device being connected by pin to the carriage boards.

Thus, with the foot massaging device located at the using position, the front face (massage face) and the rear face (footrest face) of the foot massaging device are rotationally switchable.

DISCLOSURE OF THE INVENTION

Problems to be Solved by the Invention

However, the configuration employing guiding tracks requires highly precise, careful processing in that smooth curving needs to be formed on the guiding tracks, and thus has had such an aspect that the manufacturing cost is difficult to curtail. Additionally, in view of sliding resistance that occurs against the guiding tracks, powerful driving is necessary while an idea is necessary to alleviate driving noise and vibration, resulting in an additional burden in terms of structure and weight. Thus, there has been room for improvement.

In view of the above-described problems, it is an object of the present invention to provide a massage chair which can make the structure simpler, the weight lighter, and the cost lower all at once.

Means for Solving the Problems

In order to realize the above-described object, the present invention implements the following technical means.

Namely, a massage chair with a foot massaging device according to the present invention includes a seat unit, a backrest unit provided at a rear portion of the seat unit, and the foot massaging device located at a front portion of the seat unit, wherein a back-and-forth motion mechanism joined to the foot massaging device is provided under the seat unit; and wherein when the back-and-forth motion mechanism protrudes forward, the foot massaging device advances to a using position which is located in front of the seat unit and at which a lower leg of a user can be massaged, while when the back-and-forth motion mechanism retracts backward, the foot massaging device is housed in a housing position formed under the seat unit.

Specifically, the foot massaging device located at the using position is in such a status that a bottom face of the foot massaging device faces a floor surface and a front face of the foot massaging device to massage the lower leg is oriented forward, and the foot massaging device located at the housing position is in such a status that the bottom face is oriented forward and approximately flush with a front edge portion of the seat unit, and that the front face to massage the lower leg is oriented upward.

The back-and-forth motion mechanism may be configured to carry out a protruding movement by which an upper back face portion of the foot massaging device located at the housing position is moved forward and then moved upward so as to make the foot massaging device reach the using position, and a retracting movement by which the upper back face portion of the foot massaging device located at the using position is moved downward until an upper front face portion of the foot massaging device is lower than a lower face of the seat unit and then retracted to under the seat unit so as to return the foot massaging device to the housing position.

Specifically, the back-and-forth motion mechanism may include: a link joined between a stationary pivotal support unit provided under the seat unit and a movable pivotal support unit provided on an upper back face portion of the foot massaging device so as to hold the movable pivotal support unit swingably in a back and forth direction with the stationary pivotal support unit acting as a point of support; a swing driving unit configured to impart a driving force to the link to swing in the back and forth direction; and a rolling wheel provided on a lower back face edge of the foot massaging device and held movably on the floor surface, and the foot massaging device may be configured to move to the housing position when the link swings to a backward side of a swinging area of the link, while the foot massaging device may be configured to move to the using position when the link swings to a forward side of the swinging area of the link.

In this case, such a link is suitable that is formed of a single member configured to join the stationary pivotal support unit provided at a center portion in a right-and-left direction of the seat unit to the movable pivotal support unit provided at a center portion in a right-and-left direction of the foot massaging device.

Furthermore, the link is preferably formed in a shape of C in a side view so as to curve along an upper front face portion through a top portion of the foot massaging device when the foot massaging device is located at the housing position.

The swing driving unit of the back-and-forth motion mechanism may include an electric motor-driven telescopic mechanism.

Effect of the Invention

With the massage chair according to the present invention, it is possible to make the structure simpler, the weight lighter, and the cost lower all at once.

DESCRIPTION OF REFERENCE NUMERAL

Figure 1:
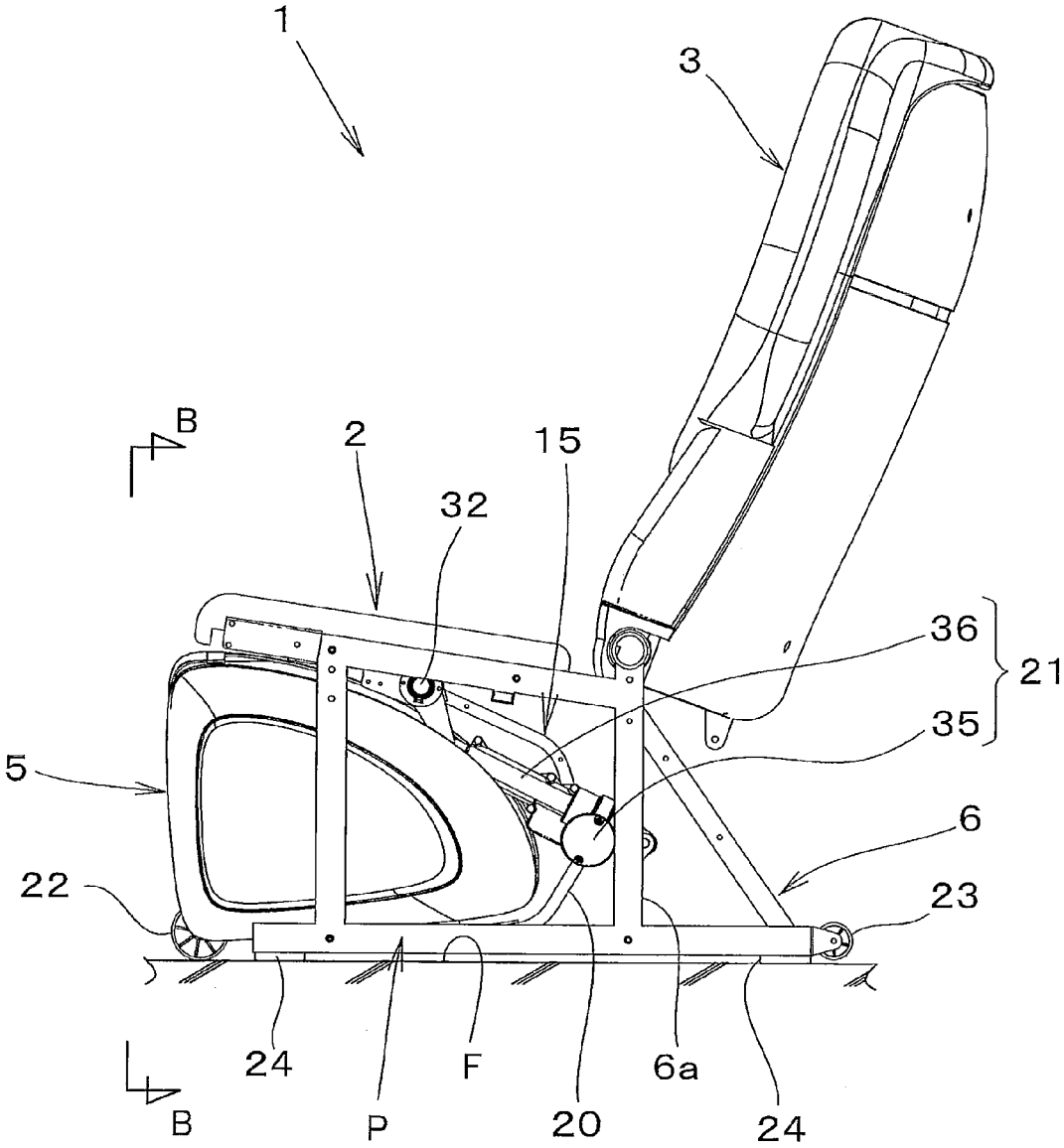
FIG. 1 is a side view of a massage chair according to one embodiment of the present invention in a partially cutaway state.

1 Massage chair
2 Seat unit
3 Backrest unit
5 Foot massaging device
15 Back-and-forth motion mechanism
20 Link
22 Rolling wheel
21 Swing driving unit
32 Stationary pivotal support unit
33 Movable pivotal support unit
35 Electric motor
36 Telescopic mechanism
F Floor surface
P Housing position
U Using position

BEST MODE FOR CARRYING OUT THE INVENTION

Embodiments of the present invention will be described below with reference to the drawings. FIGS. 1 through 10 show a massage chair 1 according to one embodiment of the present invention. It should be noted that FIG. 10 shows an overall exterior view and part of the structure is omitted in the other drawings where necessary for description purposes.

The massage chair 1 has a seat unit 2 and a backrest unit 3 provided at a rear portion of this seat unit 2, and at a front portion of the seat unit 2, a foot massaging device 5 is provided that massages the lower legs (especially, calves) of a user seated at this seat unit 2.

Figure 2:
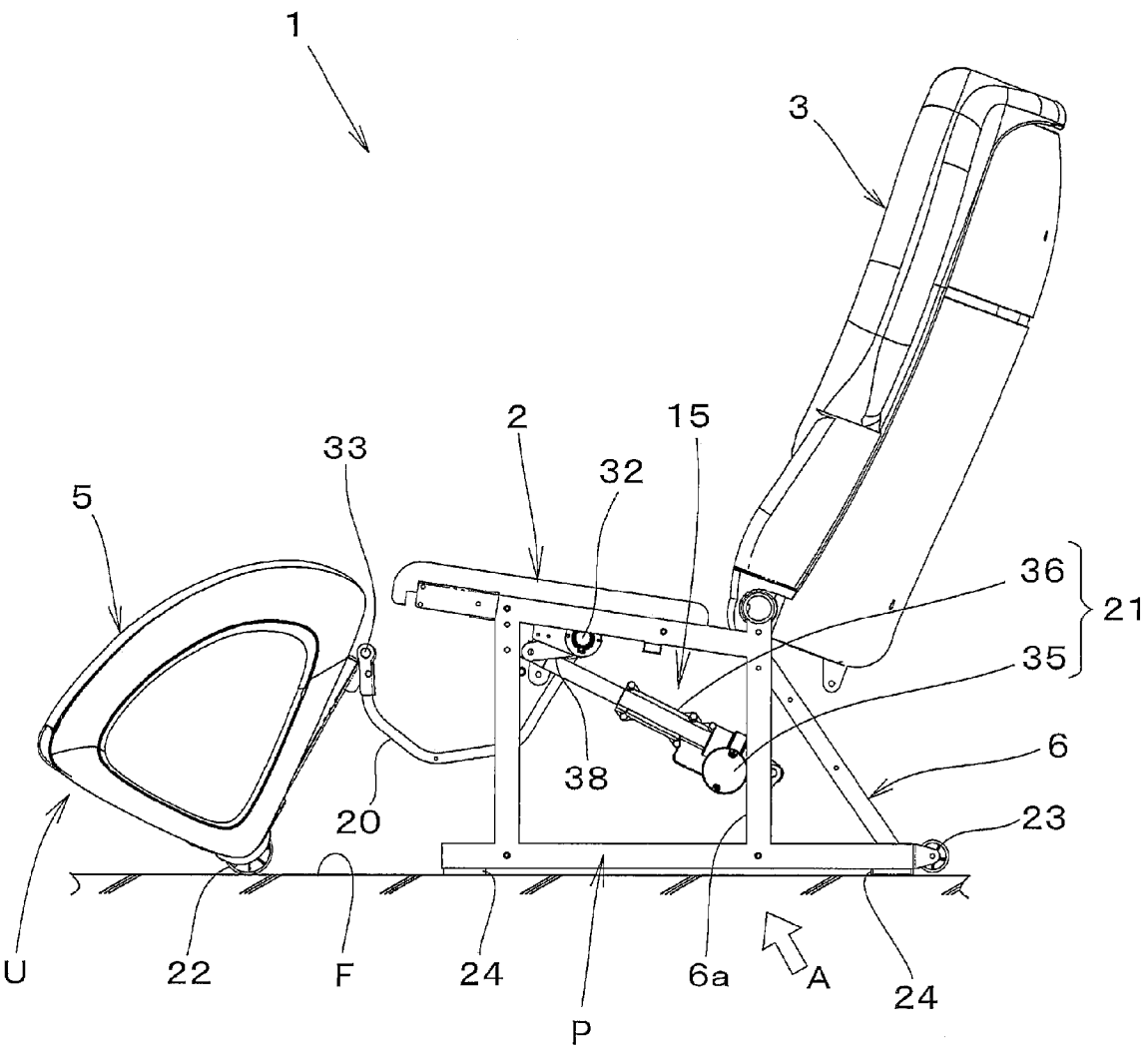
FIG. 2 is a side view showing a state in which the foot massaging device in the state in FIG. 1 is moved to a using position.

As shown FIG. 1 and FIG. 2, under the seat unit 2, a leg frame 6 is provided that is used to install this massage chair 1 on a floor surface F, and this leg frame 6 supports the seat unit 2 at a predetermined height.

Furthermore, armrests 7 are provided as if to hold both sides of the seat unit 2 (see FIG. 10), and these armrests 7 hide the leg frame 6 out of sight when viewed from outside.

It should be noted that in the following description, the right-and-left direction of FIG. 1 will be referred to as a back-and-forth direction of an actual device, and the upward-and-downward direction of FIG. 1 will be referred to as an upward-and-downward direction of the actual device. The direction orthogonal through the paper of FIG. 1 will be referred to as a right-and-left direction or a width direction of the actual device. These directions agree with those in which the user seated at the massage chair 1 sees.

The seat unit 2 has sufficient space to support the buttocks of the user from below. The backrest unit 3 is pivotally supported in such a state that a lower edge portion of the backrest unit 3 is swingable in the back and forth direction with respect to the rear portion of the seat unit 2 or with respect to a rear portion of the leg frame 6. This backrest unit 3 is configured to be reclinable because of a reclining mechanism (not shown), such as a linear actuator mechanism, disposed in the leg frame 6.

Inside the backrest unit 3, a back-dedicated massage mechanism (not shown) is provided that is vertically movable so as to carry out a massage operation such as massaging, stroking, and vibration.

The foot massaging device 5 is formed in a box shape with an approximately quadrangular shape on the front view and a roundish triangular shape on the side view. On the front face of the foot massaging device 5, there are formed a pair of right and left holding depressions 10, 10 that allow the lower legs (right and left feet) of the user to be fitted in.

Each of the holding depressions 10 has a lower leg-dedicated massage device built in internal opposing faces (both faces sandwiching a fitted leg) so as to massage the lower leg. This lower leg-dedicated massage device maybe configured to laterally swing board members that are long in the foot length direction so as to implement the massaging, or configured to use an air bag that expands and contracts by supply and exhaust of air so as to implement the massaging. The lower leg-dedicated massage device may also be a mechanism to carry out stroking, rubbing, or vibration.

This foot massaging device 5 is movable between a using position U which is located in front of the seat unit 2 and at which the lower legs of the user can be massaged, and a housing position P formed under the seat unit 2.

Specifically, a back-and-forth motion mechanism 15 is provided under the seat unit 2 (inside the leg frame 6) so that via this back-and-forth motion mechanism 15, the seat unit 2 side (leg frame 6) is configured to be joined to the foot massaging device 5. When this back-and-forth motion mechanism 15 protrudes forward, the foot massaging device 5 advances to the using position U, while when, afterward, the back-and-forth motion mechanism 15 retracts backward, the foot massaging device 5 is housed in the housing position P.

Figure 6:
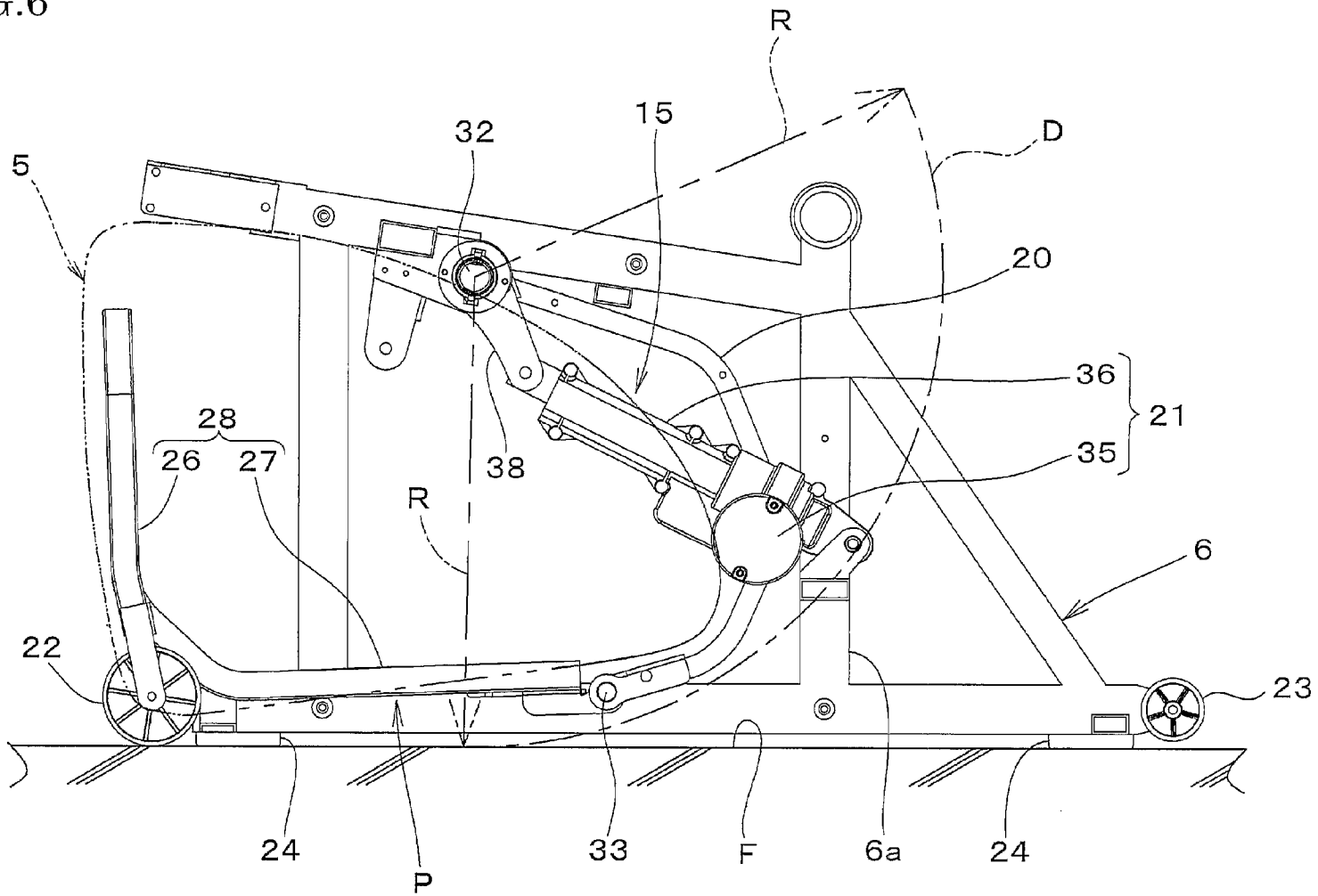
FIG. 6 is a side view of the foot massaging device in a housed state.
Figure 7:
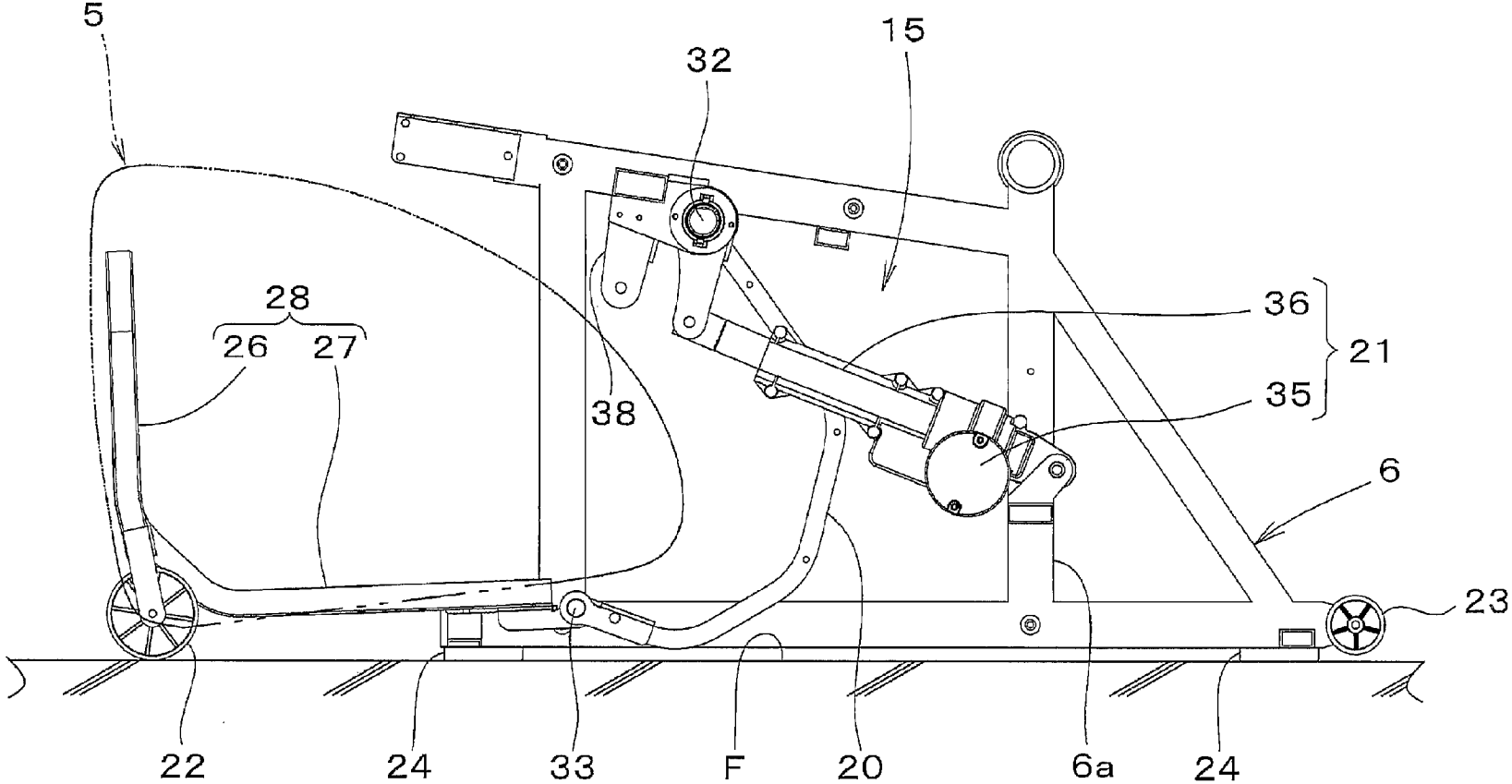
FIG. 7 is a side view of the foot massaging device in a state of being moved between the housed state and the using position and being closer to the housed state.
Figure 8:
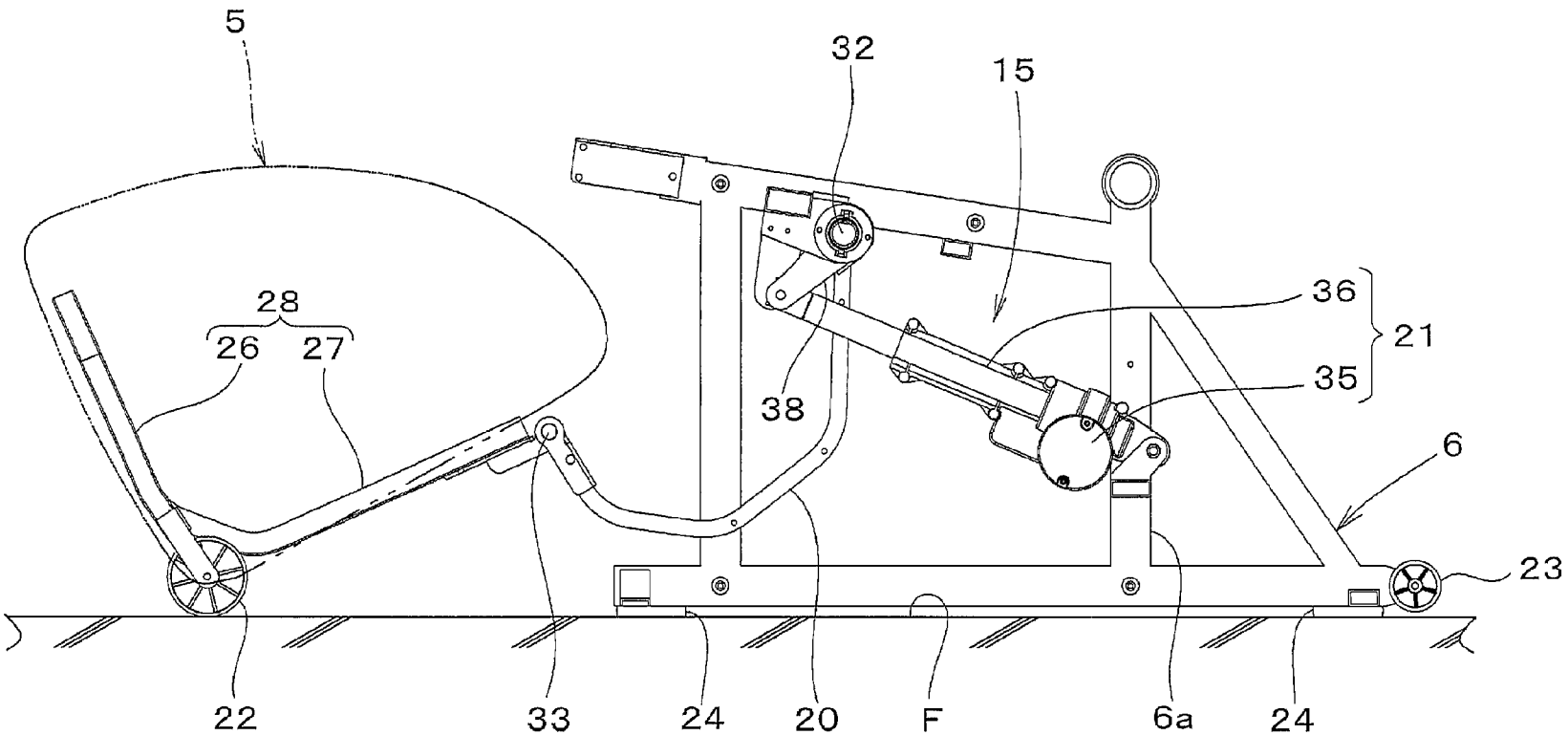
FIG. 8 is a side view of the foot massaging device in a state of being moved between the housed state and the using position and being closer to the using position.
Figure 9:
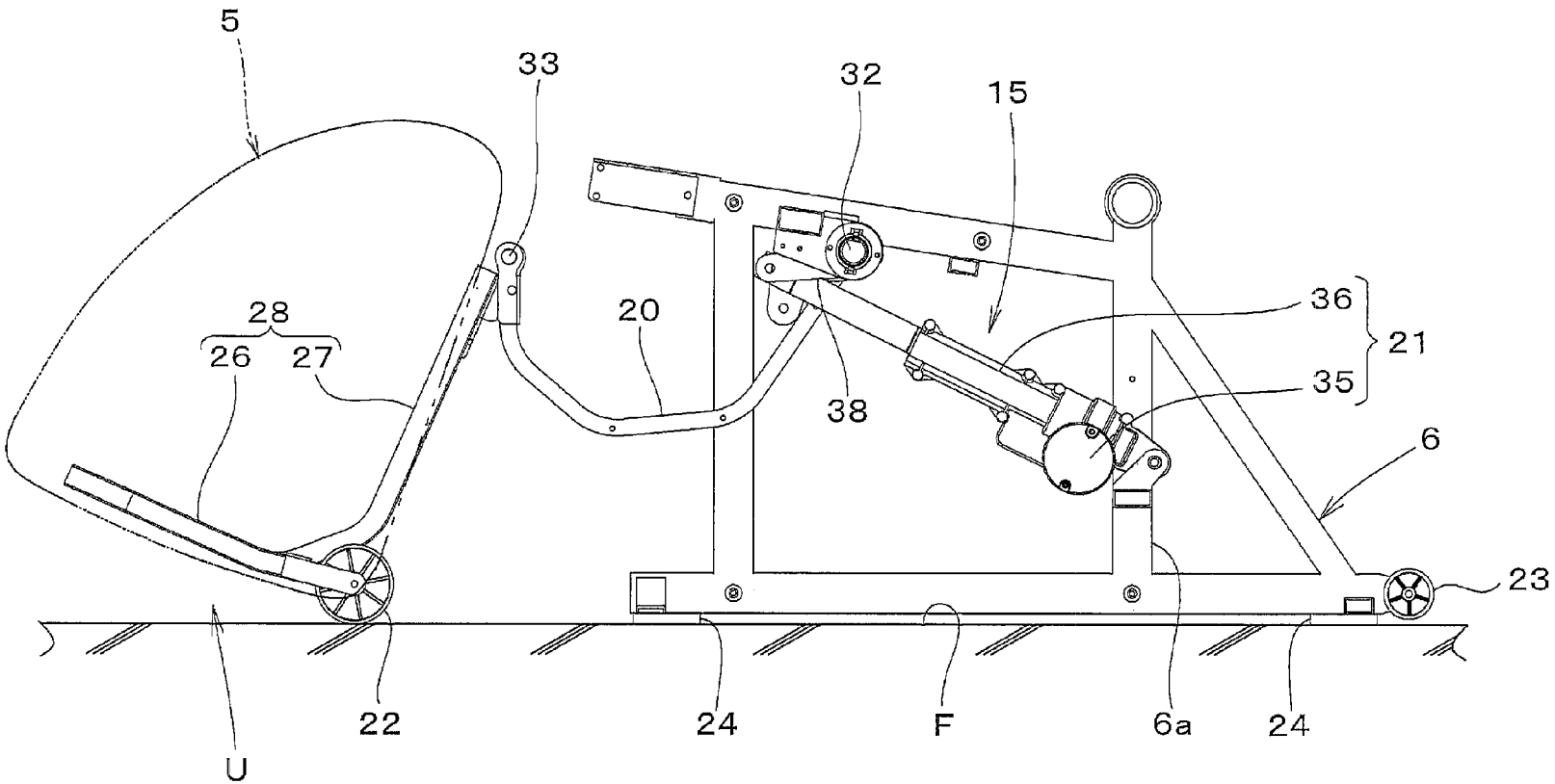
FIG. 9 is a side view of the foot massaging device in a used state.
Figure 10:
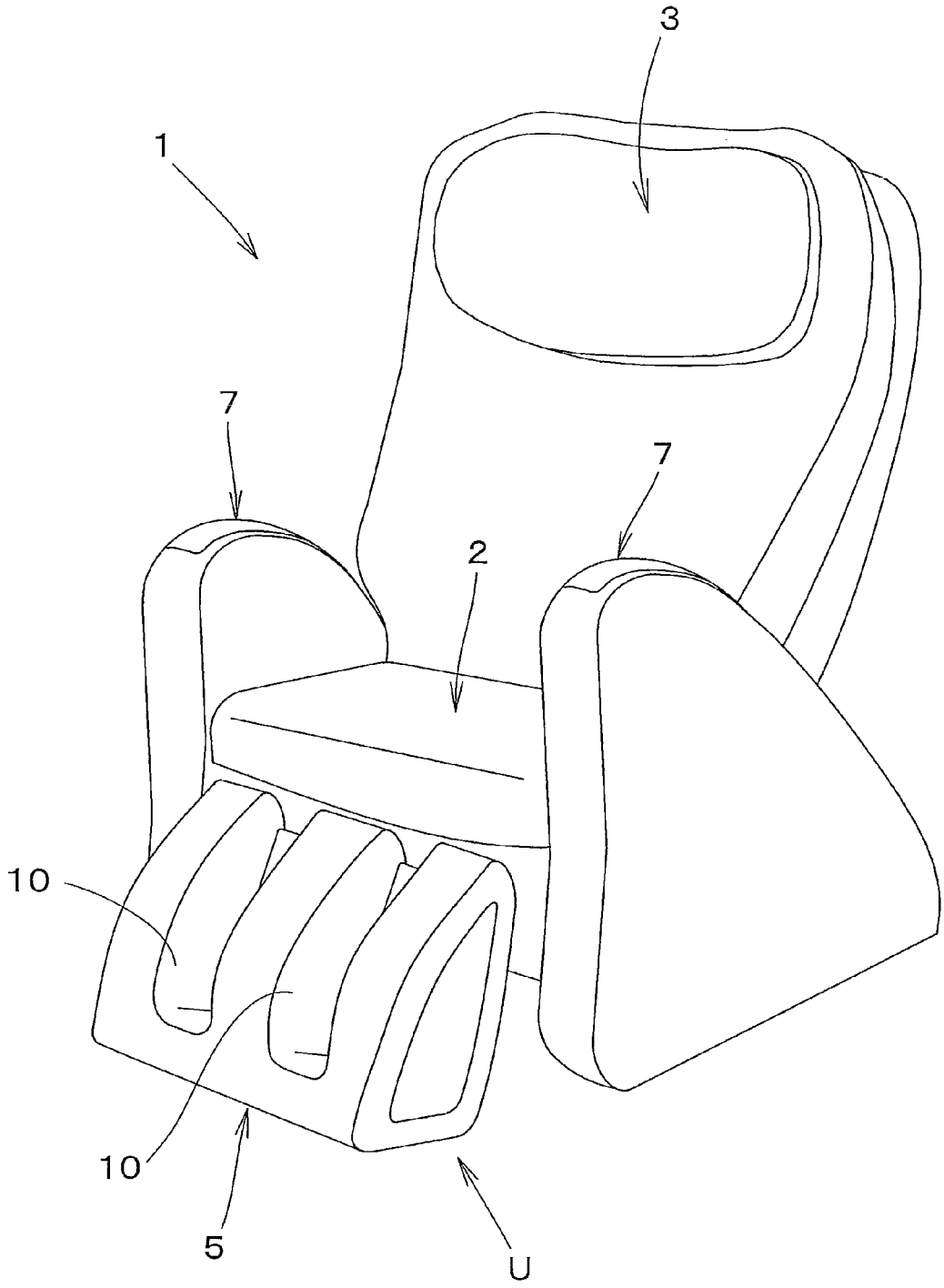
FIG. 10 is a perspective view of a massage chair according to the one embodiment of the present invention.

FIG. 6 shows a housed state of the foot massaging device 5 (the housing position P), FIG. 9 shows a used state (using position U) of the foot massaging device 5, and FIG. 7 and FIG. 8 show how to switch between the housed state and the used state (intermediate state). As clearly seen from FIGS. 6 through 9, the back-and-forth motion mechanism 15 has a link 20, a swing driving unit 21, and rolling wheels 22.

It should be noted that the leg frame 6, which supports the seat unit 2, is provided with a pair of right and left moving wheels 23 at a rear edge of a floor surface placement portion (at a bottom face of the foot massaging device 5) so as to allow for a smooth movement when the place of installation of the entire massage chair 1 is moved. Furthermore, there are provided floor attachment members 24 at four positions on the front, rear, right, and left of the floor surface placement portion so as to lift up these moving wheels 23 off the floor surface F when no movement should be made such as when the massage chair 1 is in use and thereby to maintain installation stability.

The floor attachment members 24 are preferably formed of hard rubber or the like having both vibration absorbability and resistance against slipping on the floor surface F. When the place of installation of the massage chair 1 is moved, the entire chair may be tilted backward as if only the right and left moving wheels 23 are pressed onto the floor surface F (the front portion of the chair is lifted up), so that all the floor attachment members 24 are detached off the floor surface F, and the chair may be moved by rolling the moving wheels 23.

Meanwhile, the foot massaging device 5 is supported by a moving frame 28 including a bottom face support frame 26 and a back face support frame 27 that are assembled together into an L-shape in a side view so as to secure rigidity throughout the entire device.

The link 20 is joined between a stationary pivotal support unit 32 provided under the seat unit 2 (at an upper side in the leg frame 6) and a movable pivotal support unit 33 provided at an upper back face portion of the foot massaging device 5 (at an upper portion of the back face support frame 27 of the moving frame 28). These stationary pivotal support unit 32 and the movable pivotal support unit 33 pivot on their axis center oriented in the right-and-left direction so as to support the link 20 relatively rotatably. Thus, to describe in terms of the movement of the foot massaging device 5 relative to the seat unit 2, this link 20 is configured such that the movable pivotal support unit 33 is swingable in the back-and-forth direction with the stationary pivotal support unit 32 acting as a point of support.

Figure 3:
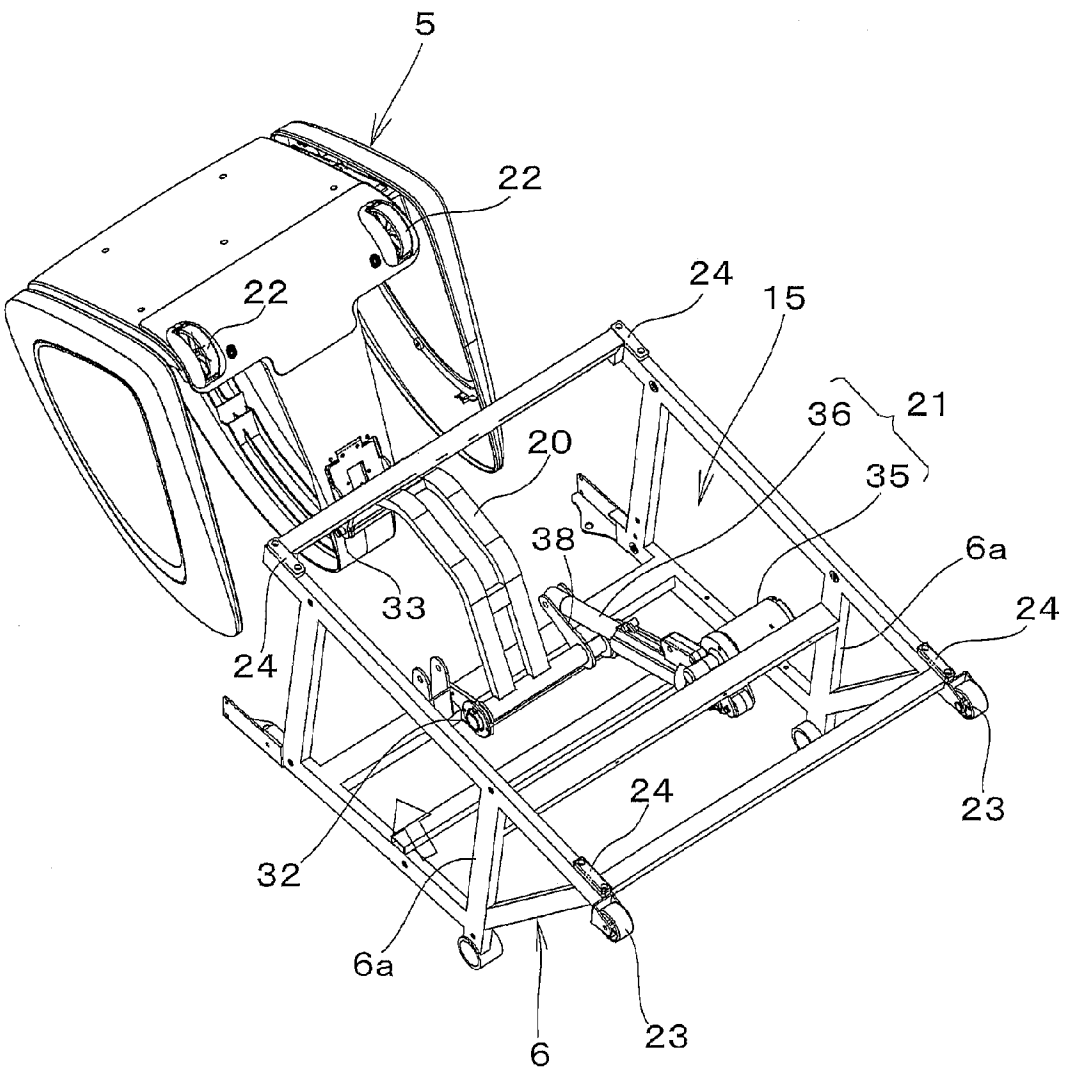
FIG. 3 is a view from an arrow A shown in FIG. 2 (perspective view from below).
Figure 4:
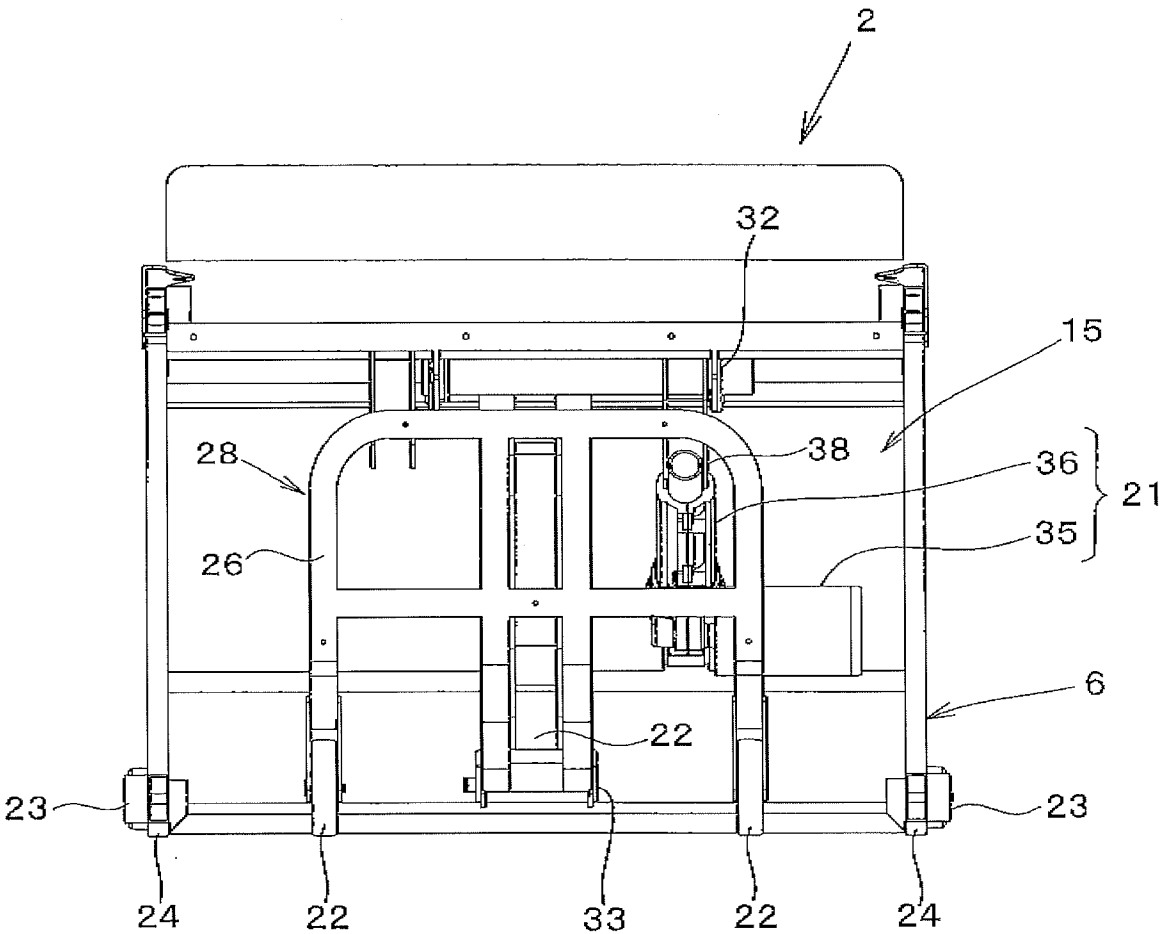
FIG. 4 is a view taken along a line B-B shown in FIG. 1.
Figure 5:
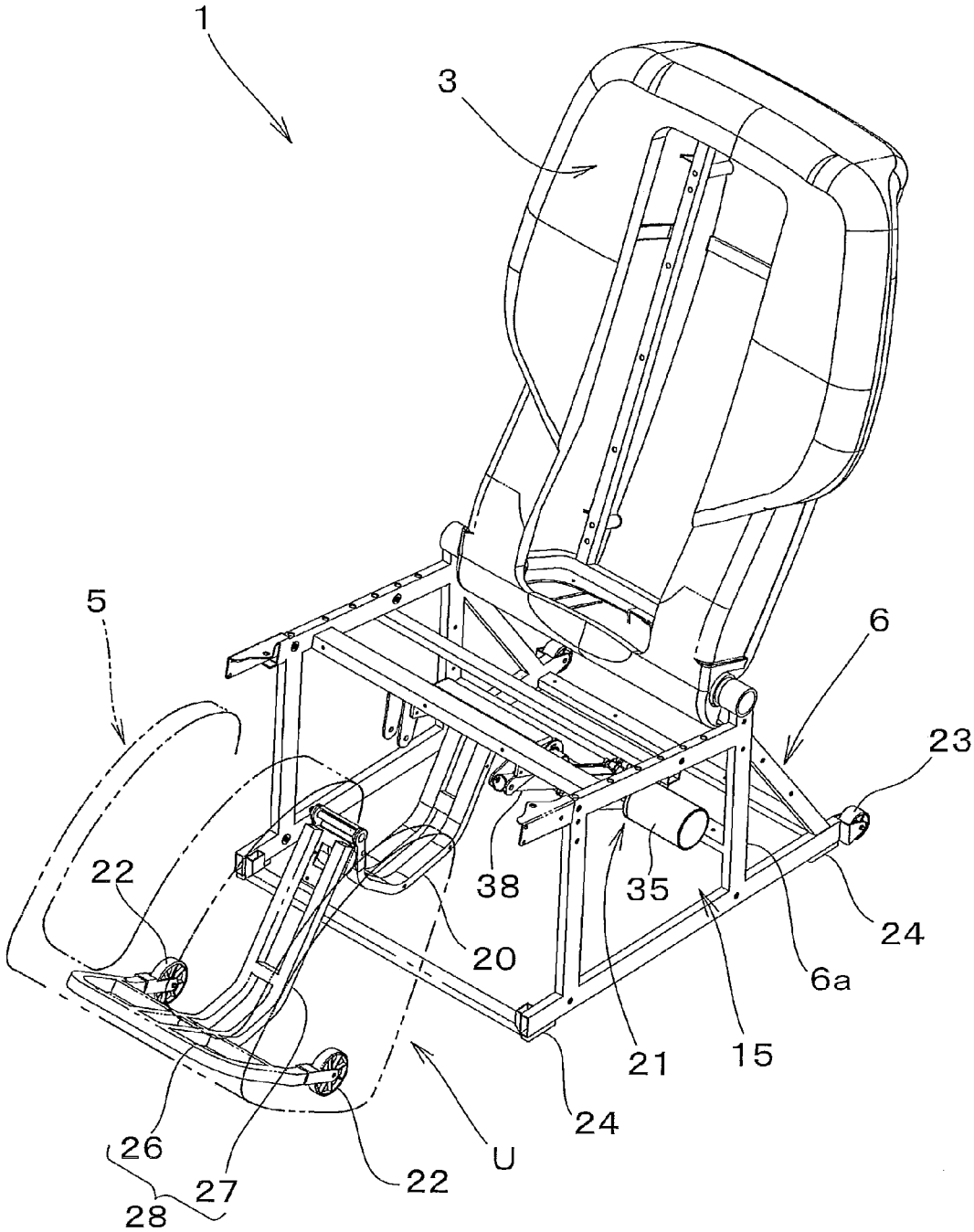
FIG. 5 is a perspective view corresponding to FIG. 2.

As shown in FIG. 3 through FIG. 5, the stationary pivotal support unit 32 is provided at a center portion in the right-and-left direction of the seat unit 2, and the movable pivotal support unit 33 is provided at a center portion in the right-and-left direction of the foot massaging device 5. Thus, only a single link 20 is provided to join these stationary pivotal support unit 32 and the movable pivotal support unit 33 together. In other words, the link 20 is formed of a single bar member.

Furthermore, the link 20 is curved in a shape of C in aside view. Specifically, to describe by referring to the state in which the foot massaging device 5 is in the housing position P under the seat unit 2 (in the state shown in FIG. 6), the link 20 has such a shape that first extends backward relative to the stationary pivotal support unit 32, and then turns downward over the upper front face portion through a top portion of the foot massaging device 5 so as to make what is called a U-turn as if to circle around behind the upper back face portion of the foot massaging device 5, and then further extends forward to arrive at the movable pivotal support unit 33.

As shown in FIG. 6, assuming an imaginary circle D having a maximum radius R defined as a line connecting the axis center of the stationary pivotal support unit 32 to the floor surface F in a shortest distance, the link 20 is formed with a size entirely encompassed within the range of this imaginary circle D having the stationary pivotal support unit 32 as a center thereof. Hence, even though the link 20 swings in the back and forth direction about the stationary pivotal support unit 32 as the center, there is no contact of this link 20 with the floor surface F.

This link 20 swings back and forth in such a manner that when the foot massaging device 5 is located at the housing position P (as in FIG. 6), the link 20 is in a backward side of a movable swing area, while when the foot massaging device 5 is located at the using position U (as in FIG. 9), the link 20 is in a forward side of the movable swing area. It should be noted that the term movable swing area refers to an area in which the link 20 swings when the foot massaging device 5 moves between the housing position P and the using position U.

The swing driving unit 21 imparts to the link 20 a driving force for its back-and-forth swing and includes, in this embodiment, a telescopic mechanism 36 that makes a telescopic movement using an electric motor 35 as a driving source. For the telescopic mechanism 36, a mechanism that uses a screw shaft (a ball screw or the like), a combined mechanism of a rack and a pinion gear, or the like, for example, may be employed.

On the pivot shaft that supports a rear end of the link 20 rotatably on the stationary pivotal support unit 32 (i.e., that rotates integrally with the link 20), a bracket member 38 is provided that rotates integrally with the pivot shaft. To this bracket member 38, a front end portion of the telescopic mechanism 36 is joined relatively rotatably. Meanwhile, a rear end portion of the telescopic mechanism 36 is joined rotatably to a vertical rod portion **6*a* of the leg frame 6**.

The rolling wheels 22 are provided at a lower back face edge of the foot massaging device 5, that is, at a corner portion between the bottom face and the back face (a linking portion of the bottom face support frame 26 and the back face support frame 27 of the moving frame 28), and held movably on the floor surface F.

Wheel-portion outer circumferential faces (tire portions) of the rolling wheel 22 are preferably formed of hard rubber or the like having both vibration absorbability and resistance against slipping on the floor surface F.

Next, the movement of the back-and-forth motion mechanism 15 of the above-described configuration will be described. First, as shown in FIG. 6, assume that the foot massaging device 5 is in the state of being at the housing position P under the seat unit 2. In this regard, the foot massaging device 5 has its bottom face oriented forward, the front face (the face provided with the holding depressions 10, 10 for the lower legs of the user to be fitted in) oriented upward, and the bottom face approximately flush with a front edge portion of the seat unit 2.

When the electric motor 35 of the swing driving unit 21 is activated, the telescopic mechanism 36 starts an extending movement. Thus, with a support of the vertical rod portion **6*a* of the leg frame 6, to which the rear end portion of the telescopic mechanism 36 is joined, the pivot shaft of the stationary pivotal support unit 32 starts rotating at the front end portion (bracket member 38) of the telescopic mechanism 36**.

In association with the above, at the link 20, the movable pivotal support unit 33 swings forward with the stationary pivotal support unit 32 acting as a point of support, and as a result, the foot massaging device 5 has its upper back face portion move forward as shown in FIG. 7. In this respect, the rolling wheels 22 roll on the floor surface F, and therefore, the foot massaging device 5 moves smoothly.

When the link 20 swings further forward, the foot massaging device 5 has its upper back face portion start moving upward as shown in FIG. 8. Then, as shown in FIG. 9, when the upper back face portion of the foot massaging device 5 advances forward beyond a lower front edge portion of the seat unit 2, this foot massaging device 5 reaches the using position U. This series of movements is the protruding movement of the back-and-forth motion mechanism 15. The foot massaging device 5 that has reached the using position U is in such a state that the bottom face of the foot massaging device 5 is oriented toward the floor surface F and the front face of the foot massaging device 5 is oriented forward. The user can put the user's feet into the respective right and left holding depressions 10, 10 of the foot massaging device 5 in this state and then activate the lower-leg massage mechanism, so as to undergo massaging comfortably.

Meanwhile, when the electric motor 35 of the swing driving unit 21 is activated inversely relative to the above from this using position U, the telescopic mechanism 36 starts a contracting movement. Thus, with a support of the vertical rod portion 6*a* of the leg frame 6, to which the rear end portion of the telescopic mechanism. 36 is joined, the pivot shaft of the stationary pivotal support unit 32 starts rotating inversely relative to the above at the front end portion (bracket member 38) of the telescopic mechanism 36.

In association with the above, at the link 20, the movable pivotal support unit 33 swings backward with the stationary pivotal support unit 32 acting as a point of support, and as a result, the foot massaging device 5 has its upper front face portion depress downward as shown in FIG. 8. As shown in FIG. 7, when the upper back face portion of the foot massaging device 5 moves downward until the upper front face portion of the foot massaging device 5 is lower than a lower portion of the seat unit 2, the foot massaging device 5 retracts backward under the seat unit 2. In this respect, the rolling wheels 22 roll on the floor surface F, and therefore, the foot massaging device 5 moves smoothly.

Then as shown in FIG. 6, the foot massaging device 5 is returned to the state of being housed in the housing position P. This series of movements is the retracting movement of the back-and-forth motion mechanism 15.

When the foot massaging device 5 is housed in the housing position P, the bottom face of the foot massaging device 5 does not protrude beyond the front edge portion of the seat unit 2, and therefore, a user who is seated on the massage chair 1 but is "not to be massaged" can maintain a comfortable posture, and at the same time the massage chair 1 provides a simple, neat appearance.

It should be noted that a preferable configuration is to disregard the implementation of the above-described retracting movement of the back-and-forth motion mechanism 15 when an operation to implement the retracting movement occurs during the time in which a sensor such as a limiting switch provided in the holding depressions 10 or the like of the foot massaging device 5 is detecting a user, or in which the massage mechanism or the lower-leg massage mechanism is in motion. Implementing such a configuration reliably prevents inconvenient situations such as aching on the user's lower legs.

Incidentally, the massage chair 1 according to the present invention will not be limited to the above-described embodiment.

For example, a pair of stationary pivotal support units 32 may be provided at both sides (i.e., two locations) of the seat unit 2 in the right-and-left direction, and a pair of movable pivotal support units 33 may be provided at both sides (i.e., two locations) of the foot massaging device 5 in the right-and-left direction. In this case, a pair of right and left (i.e., two pieces) of links 20 may be used to join the stationary pivotal support unit 32 to the movable pivotal support unit 33 at the left side and join the stationary pivotal support unit 32 to the movable pivotal support unit 33 at the right side.

Also the link 20 will not be limited to the shape of C in a side view but may be formed in a shape of a straight line.

The swing driving unit 21 may be configured such that an electric motor moves a gear mechanism which in turn renders the link 20 swing in the back and forth direction.

INDUSTRIAL APPLICABILITY

The present invention is applicable to foot massaging devices attached to massage chairs and also applicable to sofas, vehicle seats, and the like.

The invention claimed is:

1. A massage chair with a foot massaging device, comprising:

a seat, unit;

a backrest unit provided at a rear portion of the seat unit, and the foot massaging device located at a front portion of the seat unit;

a back-and-forth motion mechanism joined to the foot massaging device provided under the seat unit; and wherein when the back-and-forth motion mechanism protrudes forward, the foot massaging device advances to a using position which is located in front of the seat unit and at which a lower leg of a user can be massaged, while when the back-and-forth motion mechanism retracts backward, the foot massaging device is housed in a housing position formed under the seat unit;

wherein when the foot massaging device is located at the using position, a bottom face of the foot massaging device faces a floor surface and a front face of the foot massaging device to massage the lower leg is oriented forward;

wherein when the foot massaging device is located at the housing position, the bottom face is oriented forward and approximately flush with a front edge portion of the seat unit, and the front face to massage the lower leg is oriented upward;

wherein the back-and-forth motion mechanism comprises:

a link joined between a stationary pivotal support unit provided under the seat unit;

a movable pivotal support unit provided on an upper back face portion of the foot massaging device so as to hold the movable pivotal support unit swingably forth direction with the stationary pivotal support unit acting as a point of support;

a swing driving unit configured to impart a driving force to the link to swing in the back and forth direction; and a rolling wheel provided on a lower back face edge of the foot massaging device and held movably on the floor surface;

wherein the foot massaging device is configured to move to the housing position when the link swings to a backward side of a swinging area of the link, while the foot massaging device is configured to move to the using position when the link swings to a forward side of the swinging area of the link;

wherein the swing driving unit of the back-and-forth motion mechanism comprises an electric motor-driven telescopic mechanism;

wherein a front edge portion of the telescopic mechanism is joined at a position laterally displaced from a center portion in a right-and-left direction of the seat unit on a pivot supported on a rear edge of the link rotatably in the center portion in the right-and-left direction of the seat unit;

wherein the foot massaging device has a pair of right and left holding depressions formed at the front face of the foot massaging device and capable of accommodating the lower leg of the user; and when the foot massaging device is located in the housing position, a position of the telescopic mechanism is arranged so that the telescopic mechanism is set in one of the pair of right and left holding depressions.

2. The massage chair with the foot massaging device according to claim 1, wherein the back-and-forth motion mechanism is configured to carry out a protruding movement by which the upper back face portion of the foot massaging device located at the housing position is moved forward and then moved upward so as to make the foot massaging device reach the using position, and a retracting movement by which the upper back face portion of the foot massaging device located at the using position is moved downward until an upper front face portion of the foot massaging device is lower than a lower face of the seat unit, and then retracted to under the seat unit so as to return the foot massaging device to the housing position.

3. The massage chair with the foot massaging device according to claim 1, wherein the link is formed of a single member configured to join the stationary pivotal support unit provided at a center portion in the right-and-left direction of the seat unit to the movable pivotal support unit provided at a center portion in a right-and-left direction of the foot massaging device.

4. The massage chair with the foot massaging device according to claim 1, wherein the link is formed in a shape of C in a side view so as to curve along an upper front face portion through a top portion of the foot massaging device when the foot massaging device is located at the housing position.

* * * * *